United States Patent [19]

Quayle

[11] 4,188,732

[45] Feb. 19, 1980

[54] DISHWASHER AIRFLOW DRYING SYSTEM

[75] Inventor: Lawrence L. Quayle, Newton, Iowa

[73] Assignee: The Maytag Company, Newton, Iowa

[21] Appl. No.: 940,028

[22] Filed: Sep. 6, 1978

[51] Int. Cl.[2] ..... B08B 3/02

[52] U.S. Cl. ..... 34/54; 34/78; 34/231; 134/95

[58] Field of Search ..... 34/54, 78, 231, 45, 34/324, 53, 133; 134/95, 57 R, 57 D, 102, 103, 105; 312/214

[56] References Cited

U.S. PATENT DOCUMENTS

| | | | |
|---|---|---|---|
| 3,026,628 | 3/1962 | Berger et al. | 34/231 |
| 3,050,866 | 8/1962 | Macemon | 34/78 |
| 3,378,933 | 4/1968 | Jenkins | 34/54 |
| 3,397,708 | 8/1968 | Braden | 134/57 |
| 3,588,213 | 6/1961 | Braga | 312/214 |
| 3,876,469 | 4/1975 | Schimke | 134/95 |

*Primary Examiner*—Edward G. Favors
*Attorney, Agent, or Firm*—Richard L. Ward

[57] ABSTRACT

A dishwashing apparatus including a washing chamber having an access door. An air inlet is located in the bottom wall of the washing chamber and includes a motor driven blower for forcing ambient-temperature air into the washing chamber. The air is directed over a heating element to pick up heat, rises through the dishes and flows out of the washing chanber through a vent in the access door. Valves are located in the air inlet and in the vent which are sequentially opened by the forced airflow into the washing chamber. These valves automatically gravitationally close when blower operation ceases.

8 Claims, 8 Drawing Figures

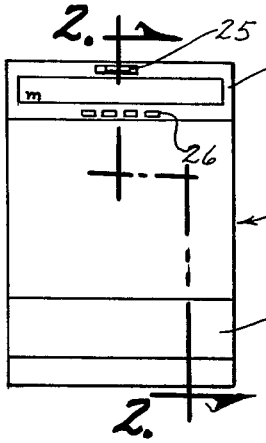
Fig. 1
Fig. 2
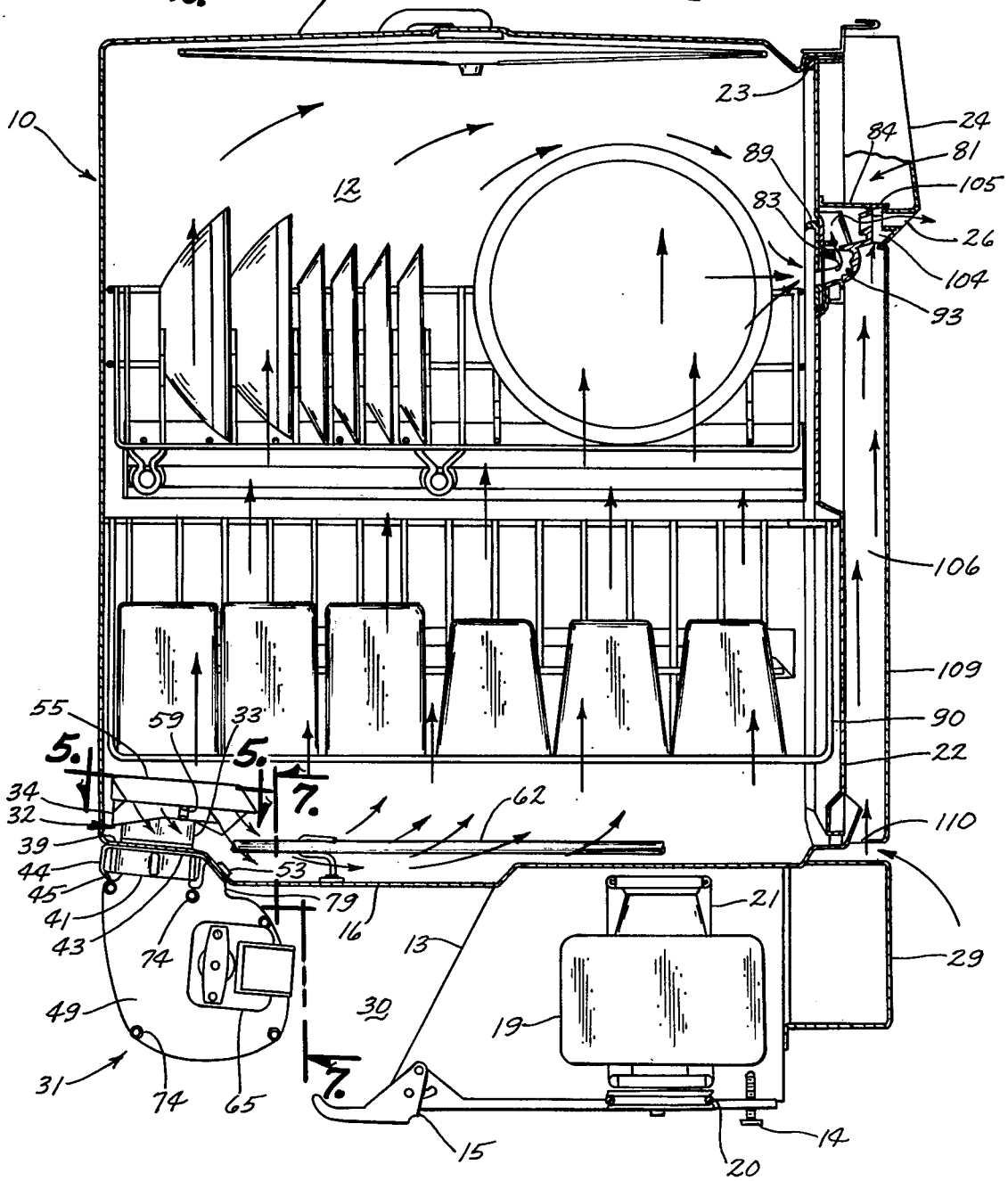

DISHWASHER AIRFLOW DRYING SYSTEM

BACKGROUND OF THE INVENTION

Field of the Invention

This invention relates generally to the field of dishwashers and more particularly to an airflow drying system therefor.

Several prior art patents show forced air drying systems applied to dishwashers. None of these systems, however, show a drying system which utilizes an automatically closed valve arrangement in both the inlet and outlet which are responsive to airflow.

Berger et al., in U.S. Pat. No. 3,026,628, discloses a motor driven blower system for introducing externally heated air into the washing chamber through a pair of conduits. This patent does not teach the use of valves or any other means for closing the air inlet or outlet during other than the drying operation.

Jenkins, in U.S. Pat. No. 3,378,933, also discloses a motor driven blower system for use in drying articles washed in a dishwashing apparatus. Jenkins teaches the use of an external heater for heating the air and also utilizes an electrically-responsive valve at the blower inlet for controlling the flow of air through the blower. A cover is pivotally mounted on the inlet conduit within the washing chamber and is responsive to airflow for opening and closing. There is no disclosure of venting hot-moist air from the dishwashing chamber.

SUMMARY OF THE INVENTION

It is an object of the invention to provide a forced air drying system for a dishwasher which includes automatically closed valve means in both the air inlet and air outlet.

It is a further object of the instant invention to provide valve means in the air drying system responsive to airflow through the washing chamber for opening the inlet and outlet.

It is a still further object of the instant invention to provide an air drying system for a dishwashing apparatus wherein the air inlet and air outlet are both automatically closed during operation of the dishwasher except during the drying operation.

It is a still further object of the instant invention to provide an air drying system where hot-moist air is substantially prevented from escaping from the washing chamber except during the drying operation.

The instant invention achieves these objects in an airflow system for a dishwasher which has a washing chamber, apparatus for washing articles within the chamber and an access door operable between open and closed positions relative to the chamber. A sequential controller is provided for controlling the dishwasher through a sequence of operations including an article washing operation and an article drying operation. An air inlet conduit is provided for defining an airflow path into the chamber. An air circulation system communicates with the chamber through the air inlet conduit for introducing an airflow into the chamber during the article drying operation. An air outlet is located in the access door for exhausting to the atmosphere the airflow from the chamber after passing over the articles. Inlet and outlet valve mechanisms are sequentially operable to open postures responsive to the airflow induced by the air circulation system. The valve mechanisms are automatically operable to closed postures upon interruption of the airflow.

Operation and construction of the air drying system as well as further objects and advantages thereof will become evident as the description proceeds and from an examination of the accompanying four pages of drawings.

BRIEF DESCRIPTION OF THE DRAWINGS

The drawings illustrate a preferred embodiment of the invention with similar numerals referring to similar parts throughout the several views, wherein:

FIG. 1 is a front view of a dishwashing machine;

FIG. 2 is a vertical sectional view taken generally along lines 2—2 of FIG. 1;

DESCRIPTION OF A PREFERRED EMBODIMENT

Figure 3:
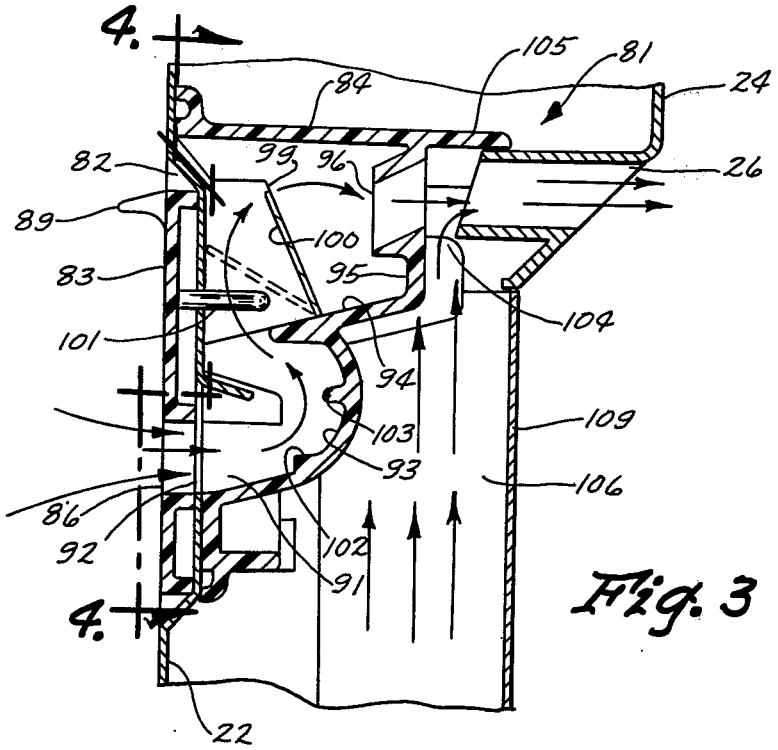
FIG. 3 is an enlarged fragmentary view through the door vent similar to that portion shown in FIG. 2.

Referring to the drawings there is shown in FIG. 1 a dishwashing apparatus 10. As further shown in FIG. 2, the dishwashing apparatus 10 includes a tub 11 forming a washing chamber 12 to which is attached side supports 13 extending downwardly to support the dishwashing apparatus 10 on the floor of an appropriate enclosure.

As shown in FIG. 2, the dishwashing apparatus 10 is supported on a plurality of floor-engaging members including a pair of screw-in feet 14 at the front of the machine which are easily adjustable from the front of the machine and also including a pair of pivotally mounted feet 15 at the rear of the side supports 13. The pivoted feet 15 are also adjustable from the front of the machine. This adjustable foot mechanism 15 is more particularly disclosed and claimed in U.S. Pat. No. 3,750,989 issued Aug. 7, 1973 to Richard P. Bergeson and assigned to the assignee of the instant invention.

The tub 11 or washing chamber 12 has a bottom wall 16 which includes a generally central recess and opening in which is positioned a combination sump and pump assembly (not shown) including a recirculating pump operable for effecting a recirculation of washing liquid in the washing chamber 12 and a drain pump for removing washing liquid from the washing chamber 12. The combination sump and pump assembly is connected to a drive motor 19 through a round stretch belt 20 as generally shown in FIG. 2. The drive motor 19 is resiliently mounted to a side support 13 through a mounting bracket 21 as also shown in FIG. 2. The pump and sump assembly and its connection to the drive motor 19 is more particularly disclosed and claimed in U.S. Pat. No. 3,963,046 issued June 15, 1976 to Richard P. Bergeson and assigned to the assignee of the instant invention.

An access door 22 is provided at the front of the dishwashing apparatus 10 which is operable between an open position and a closed position to provide access to the interior of the washing chamber 12 for loading and unloading dishes and other utensils. A gasket 23 or other suitable seal means is provided around substantially all of the periphery of the access door 22 to prevent washing liquid from being discharged onto the floor area adjacent the dishwashing apparatus 10.

The upper portion of the access door 22 mounts a control panel 24 for housing various switches and a timer or sequential control means (not shown). A door latching device 25 is also mounted within the control panel 24 and serves to lock the access door 22 in a closed position when the pump is in operation. The control panel 24 further includes a plurality of tunnel shaped openings 26 as in FIG. 3 to provide a vent path for the escape of hot-moist air from the washing chamber 12 during the dry portion of a cycle of operations and as will be more fully described hereinafter.

FIGS. 1 and 2 show an access cover 29 below the access door 22 which is removable from the front of the dishwashing apparatus 10. Removal of the access cover 29 provides access to a component compartment 30 as shown in FIG. 2 and allows the drive motor 19, blower assembly 31 and various other components to be serviced from the front of the dishwashing apparatus 10.

When viewed from the front of the dishwashing apparatus 10, as in FIG. 1, the air inlet 32 is located in the right hand rear corner of the tub 11 or washing chamber 12. FIGS. 2 and 5–8 show the assembly of the air inlet 32 and its associated mechanism to the washing chamber 12.

Figure 5:
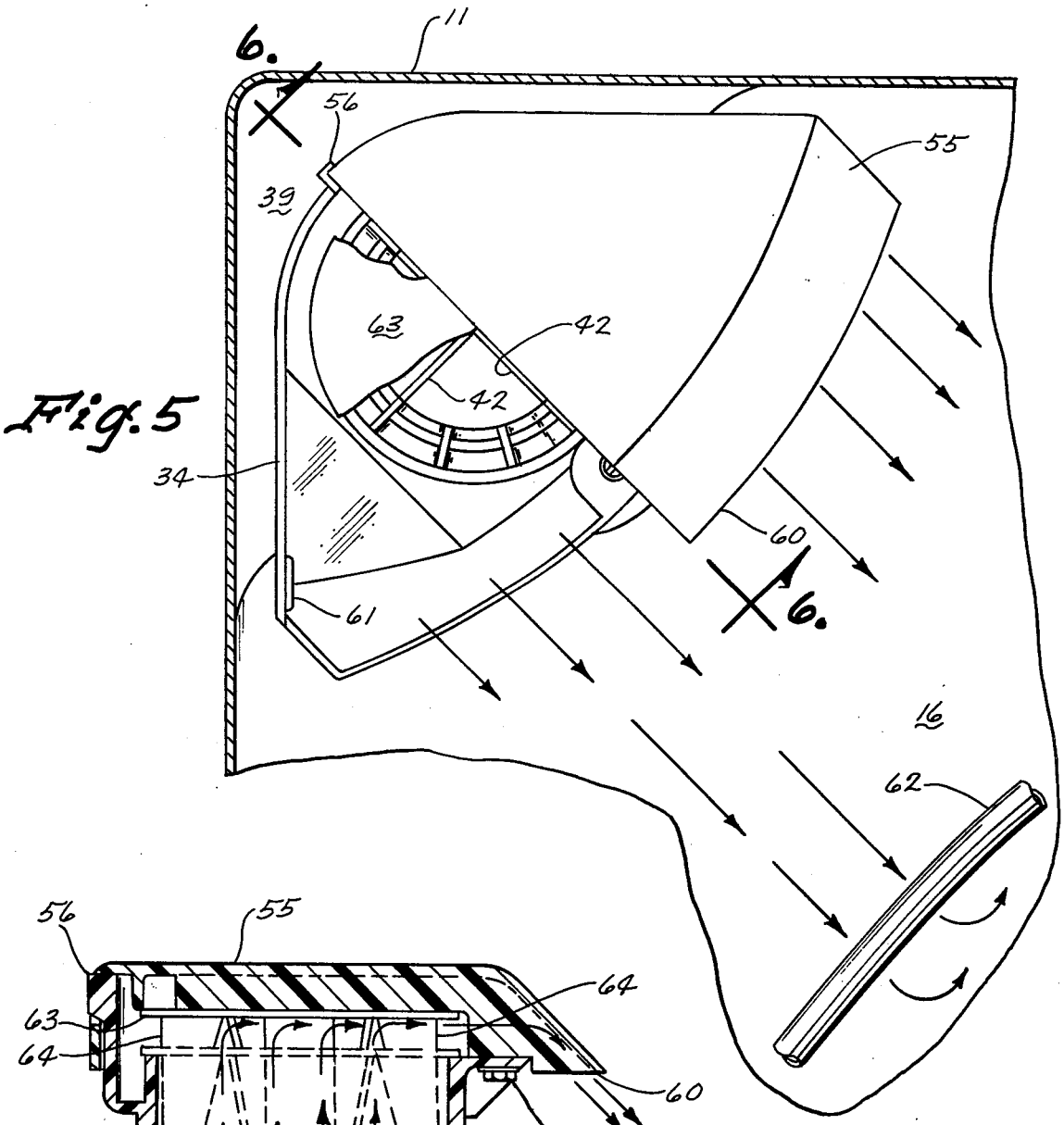
FIG. 5 is a sectional view of the air inlet taken generally along lines 5—5 of FIG. 2.
Figure 6:
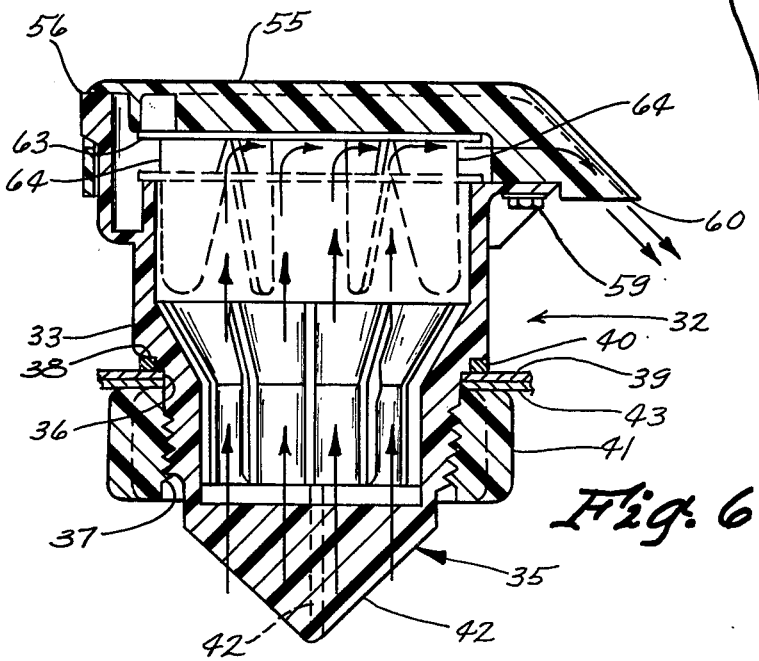
FIG. 6 is a sectional view taken generally along lines 6—6 of FIG. 5.

The air inlet 32 as best shown in FIGS. 5 and 6, is comprised of a molded thermoplastic member which includes an inlet housing defining a conduit 33. This conduit 33 further includes a guide portion 35 at one end and a flared air spreader or diffuser portion 34 at the opposite end.

The conduit 33 end which includes the guide portion 35 is smaller in diameter than the remainder of the conduit 33. This portion of the conduit 33 has molded threads 37 spaced from the guide portion 35 and a support shoulder 38 for seating and retaining a gasket 40 on the conduit 33.

The air inlet 32 is secured to an elevated surface 39 of the bottom wall 16 of the washing chamber 12 from within the chamber 12 by inserting the guide end 35 of the conduit 33 through the mounting hole 36. The guide portion 35 of the conduit 33 thus extends into the component compartment 30 of the dishwashing apparatus 10 and a thermoplastic nut 41 is hand tightened onto the conduit 33 to secure the air inlet 32 to the washing chamber 12 and to seal the gasket 40 to the bottom wall 16.

Figure 8:
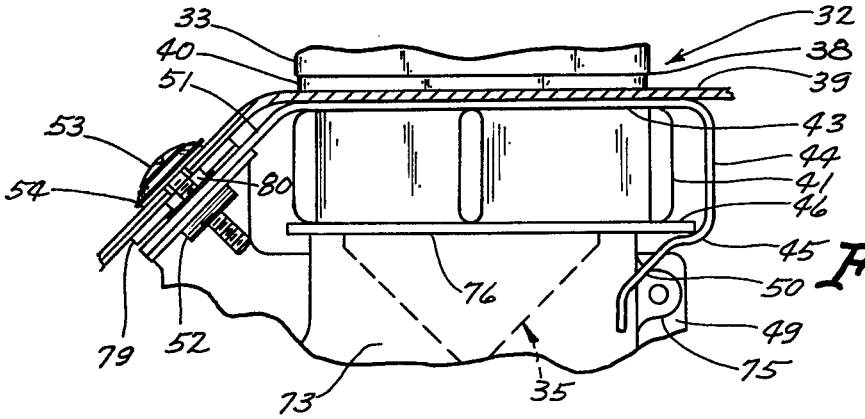
FIG. 8 is a fragmentary view taken along lines 8—8 of FIG. 7.

The guide portion 35 of the conduit 33 is made up of two intersecting rib sections 42 which depend from the conduit 33 and which form downwardly extending triangular members as shown in FIGS. 5, 6 and 8. The guide portion 35 is operable for guiding and aligning the blower assembly 31 with the axis of the air inlet 32.

The flared portion 34 of the conduit 33 is located within the washing chamber 12 as shown in FIGS. 5 and 6. The conduit 33 flares out in an opened fan-like shape and functions as an air diffuser or spreader to distribute incoming air within the washing chamber 12.

Figure 7:
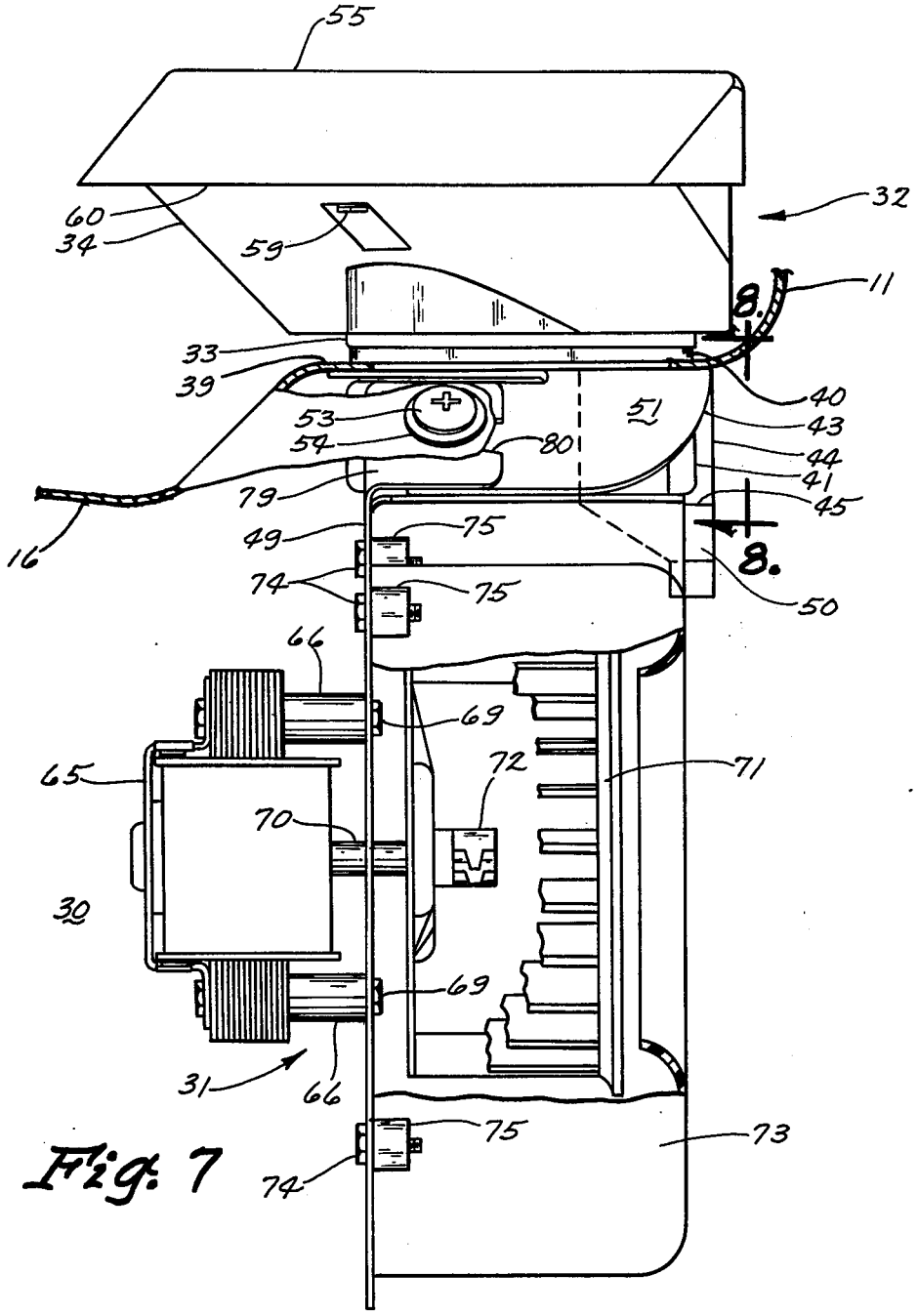
FIG. 7 is a fragmentary section view of the air inlet and blower taken generally along lines 7—7 of FIG. 2.

As shown in FIGS. 7 and 8, a sheet metal blower support bracket 43 having an annular ring which slips over the threaded portion 37 of the conduit 33 is captured between the plastic nut 41 and the outside surface of the bottom wall 16 of the washing chamber 12. This bracket 43 includes a downwardly projecting leg 44 which has an inwardly protruding tab 45, as shown in FIG. 8, for engaging with an ear portion 46 of the blower bracket 49 to partially support the blower assembly 31 which will be discussed in further detail herein. Extending angularly downward from the tab 45 is a guide 50 which engages with the ear portion 46 of the blower bracket 49 during assembly to insure that the ear portion 46 properly contacts and is supported by the tab 45 as shown in FIG. 8. The blower support bracket 43 also includes an angularly downwardly projecting tab 51 as shown in FIGS. 7 and 8 which mounts a spring clip type threaded fastener 52. The fastener 52 is located to receive a machine screw 53 from inside the washing chamber 12. A seal washer arrangement 54 is located under the head of the screw 53 to prevent leakage of washing liquid from the washing chamber 12.

A fan-shaped thermoplastic diffuser cap 55 matches the flared fan-shaped portion 34 of the conduit 33 and as shown in FIG. 6 is secured to the flared portion 34 of the conduit 33 by a molded slot and tab arrangement 56 on one side and by a thread forming screw 59 on the other side. The diffuser cap 55 has a downwardly extending frontal lip 60 which hinders washing liquid from entering the conduit 33. The extremities of the flared portion 34 extend downwardly toward drain slots 61 in the outer edges of the fan as shown in FIG. 5. If washing liquid should gain access to the fan-shaped portion 34 of the conduit 33 it will be drained back into the washing chamber 12 by the drain slots 61 in the extremities of the flared portion 34 of the conduit 33. The frontal lip 60 of the diffuser cap 55 directs ambient-temperature air downwardly and outwardly toward a circular calrod heater 62 secured to the bottom wall 16 of the washing chamber 12.

As further shown in FIGS. 5 and 6 a disk-shaped air valve or baffle 63 is located at the egress of the conduit 33 directly subjacent the diffuser cap 55. This air valve 63 is molded of a thermoplastic material and has a plurality of downwardly projecting legs 64 which form a diameter slightly smaller than the inner diameter of the conduit 33. These legs 64 serve to maintain the air valve 63 generally centered on the inner diameter of the conduit 33. The air valve 63 is normally in the closed posture as indicated by the dashed lines in FIG. 6 but is moved to and maintained in the full line open posture by airflow into the washing chamber 12. The air valve 63 in the conduit 33 in this particular embodiment of the invention prevents the escape of suds and foam from the washing chamber 12 during the washing portion of a cycle of operations.

The air circulation means or blower assembly 31 is best shown in FIGS. 2 and 7. The blower assembly 31 is mounted to the conduit 33 from beneath the tub 11 or washing chamber 12 through the support bracket 43. The blower assembly 31 is secured in the mounted position by the machine screw 53 and seal 54 arrangement shown in FIGS. 7 and 8 and is thus effectively clamped to and supported by the tub 11 through the support bracket 43.

The blower assembly 31 includes a sheet metal blower bracket 49 which serves as a mounting plate for the various components of the blower assembly 31. A fractional horsepower electric motor 65 is secured to one side of the blower bracket 49 as best shown in FIG. 7 through a pair of stand-off posts 66 and threaded fasteners 69. The motor shaft 70 protrudes through to the opposite side of the blower bracket 49 and a plastic blower wheel 71 is pushed onto the shaft and secured thereon by a spring clip 72.

After the blower motor 65 and blower wheel 71 have been assembled to the blower bracket 49, a thermoplastic blower housing 73, having the proper scroll shape, is secured to the bracket 49 as shown in FIG. 7 by a plurality of thread forming fasteners 74 which are threaded into pilot holes in the bosses 75 molded into the housing 73.

As FIGS. 7 and 8 show, the upper portion of the blower bracket 49 is formed at a right angle to the bracket 49 and extends over the thermoplastic blower housing 73. The formed portion 76 of the bracket 49 includes an ear portion 46 which is supported on the tab 45 of the blower support bracket 43 as best shown in FIG. 8.

The upper portion of the blower bracket 49 further includes a tab 79 which is shaped to conform angularly to the configuration of the elevated surface 39 of the bottom wall 16 of the washing chamber 12. This tab 79 has a generally V-shaped notch 80 for receiving the threaded portion of the machine screw 53 and seal 54 arrangement extending from inside the washing chamber 12.

When the dishwashing apparatus 10 has been installed in a home, access to the component compartment 30 for service is from the front of the apparatus 10 by removal of the access cover 29. The blower assembly 31 is mounted in the operational position as shown in FIGS. 2 and 7 as follows: The access cover 29 is removed for accessibility to the component compartment 30 from the front of the dishwasher 10. The blower assembly 31 is moved into vertical alignment and centered on the air inlet 32 from the front of the dishwasher 10 by mating the blower assembly 31 with the locator member or guide means 35 on the bottom of the conduit 33 as shown in FIG. 6 and in dashed lines in FIG. 8. The blower assembly 31 is then rotated counterclockwise approximately ⅛ turn to align the blower bracket ear 46 with the inwardly protruding tab 45 of the blower support bracket 43. This ⅛ turn also moves the V-shaped notch 80 of the blower tab 79 into position directly above the blower support bracket tab 51 and its spring type threaded fastener 52. The V-shaped notch 80 encompasses the machine screw 53 which extends into the threaded fastener 52 from within the washing chamber 12 as shown in FIG. 8. The machine screw 53 is tightened from within the washing chamber 12 to secure the blower assembly 31 in the operational posture of FIG. 7 by clamping the blower bracket tab 79 between the washing chamber 12 outer wall and the blower support bracket tab 51 to effectively support the blower assembly 31 from the tub 11. Through this ⅛ turn mounting of the blower assembly 31 to the air inlet 34, the unit can be readily serviced from the front of the dishwashing apparatus 10 without removing the dishwashing apparatus 10 from the cabinetry.

The feature of the air inlet system is also disclosed and is claimed in a copending application entitled "Air Inlet For A Dishwashing Apparatus" filed on an even date with this application by Lawrence L. Quayle and assigned to the assignee of the instant invention.

Figure 4:
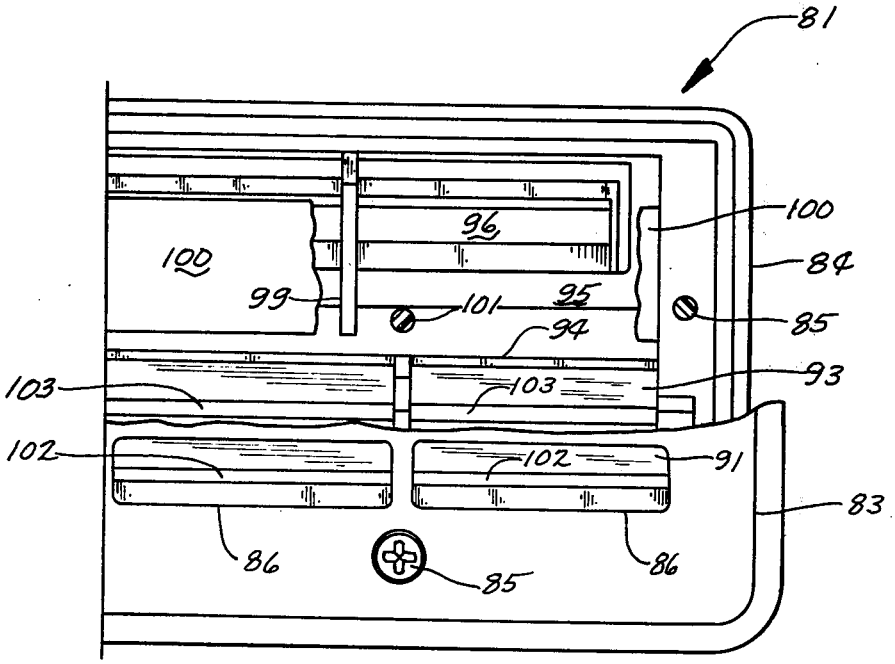
FIG. 4 is a fragmentary sectional view of the door vent taken generally along lines 4—4 of FIG. 3.

As shown in FIGS. 2, 3 and 4 the access door 22 includes a vent-air outlet system 81 mounted in its upper section which is operable for exhausting hot-moist air from the washing chamber 12 during a drying portion of a predetermined cycle of operations. The vent 81 is generally centered on the width of the access door 22 and, as shown in FIG. 3, a depression 82 is formed in the access door 22 so that the cover portion 83 of the vent 81 located inside the washing chamber 12 is substantially flush with the interior surface of the access door 22.

FIG. 4 shows the right one-half of the vent-air outlet system 81 from inside the washing chamber 12 with the vent system 81 being symmetrical about the center line. The vent duct housing 84 is secured to the access door 22 by a plurality of thread forming fasteners 85 which extend through the cover 83 on the inside of the access door 22, through clearance holes in the access door 22 and thread into the vent duct housing 84 on the outside of the access door 22.

The cover 83 is molded of a thermoplastic material and is generally rectangular in shape. The lower portion of the cover 83 includes a plurality of rectangular slots 86 for venting hot-moist air from the washing chamber 12. The cover 83 also includes, at its extreme upper center section, a lug 89 protruding into the washing chamber 12. When the access door 22 is in the opened position for loading or unloading dishes, the lower basket 90 can be pulled out onto the access door 22 to facilitate loading or unloading. The lug 89 on the cover 83 is radiused to engage with a section of the basket 90 and stop outward movement of the basket 90 to keep the operator from pulling the basket 90 onto the floor.

As previously mentioned, the vent duct housing 84 is molded of a thermoplastic material and is located on the outside of the access door 22. The vent duct housing 84 is also substantially rectangular in shape. The lower portion of the vent duct housing 84 has a lengthwise opening 91 which juxtaposes the plurality of rectangular slots 86 in the cover 83 and a passageway 92 in the access door 22. This vent duct opening 91 extends forward, toward the exterior of the dishwashing apparatus 10, through an upwardly curving arcuate portion 93 as best shown in FIG. 3.

A pair of horizontal rib sections 102 and 103 extend across the vent on the face of the upwardly curving arcuate portion 93 and serve to reduce jets of washing liquid, which may enter the vent duct housing 84 through the cover slots 86, into droplets of washing liquid. This reduction action prevents a jet of washing liquid from following the upwardly curving arcuate portion 93 and possibly escaping from the washing chamber 12. The sloping surfaces of this section also tend to drain washing liquid back into the washing chamber 12.

Located directly above the arcuate portion 93 is a ledge or landing 94 which extends generally upwardly and outwardly as shown in FIG. 3 and terminates at a vertical wall section 95. This vertical wall section 95 has a rectangular slot or opening 96 extending substantially the full width of the vent duct 84 for exhausting hot-moist airflow from the washing chamber 12. The vent duct opening 91 and the slot or opening 96 are located in parallel but vertically spaced apart planes in said vent duct housing 84. A serpentine, water-excluding S-shaped airflow path is thus defined as generally indicated by the arrows in FIG. 3.

A pair of substantially vertical ribs 99 extend upwardly from the ledge or landing 94 and serve as stops for a flapper valve mechanism 100 in the vent duct housing 84. A rectangular flapper valve 100 made of thermoplastic, fiberboard or aluminum material is inserted in the vent duct housing 84 as shown in FIGS. 3 and 4. The flapper valve 100 is pivoted from the dashed line position to the full line position of FIG. 3 about the base of the vertical ribs 99. FIG. 3 also shows one of a pair of pins 101 which are molded to the back side of the vent cover 83 and protrude into the vent duct housing 84. These pins 101 retain the lower portion of the flapper valve 100 in close proximity to the base of the vertical ribs 99.

When the flapper valve 100 is closed by gravity against the access door 22, as shown in dashed lines in FIG. 3, natural airflow through the vent duct 22 is precluded. The flapper valve 100 will be opened to the full line position of FIG. 3 by forced airflow through the dishwashing apparatus 10 when the blower 31 is operated during the dry portion of a predetermined cycle of operations. Gravitational return of the flapper valve 100 to the closed dashed line position of FIG. 3 when blower 31 operation is terminated is assured by the slightly over center position of the top of the flapper valve 100 when opened against the ribs 99. At other times the washing chamber 12 will be essentially sealed to the escape of hot-moist air except for small amounts around the periphery of the flapper valve 100, through the water inlet opening (not shown) and through a small gap between the ends of the access door gasket 23.

As FIGS. 2 and 3 show, the control panel openings 26 are tunnel-shaped and extend inwardly to a position directly adjacent the exhaust slot 96 in the vent duct housing 84 with approximately a ¼ inch gap 104 between the slot or opening 96 and panel openings 26. A hood 105 projects beyond the vent duct slot 96 and covers the upper portion of the control panel tunnel openings 26. Ambient temperature air enters the space 106 between the access door 22 and the door panel 109 through the opening 110 at the bottom of the door panel 109 and rises between the access door 22 and the panel 109 through natural convection. When the blower 31 is forcing hot-moist air from the washing chamber 12 during dry, the ambient temperature air enters the ¼ inch air gap 104 at the lower portion of said openings 26 and mixes with the hot-moist air exhausting from the washing chamber 12 to help prevent condensation of moisture on the control panel 24 exterior surfaces. The hood 105 covering the control panel openings 26 lies directly upon the top surface of the tunnel openings 26 and prevents either ambient or hot-moist air from flowing into the upper portion of the interior of the control panel 24.

In operation, during the "washing and rinsing" portion of the cycle of operations, sufficient air will escape around the periphery of the flapper valve 100 and at the water inlet to preclude the actual opening of the flapper valve 100 prior to the "dry" portion of the cycle. Opening the access door 22 during the "washing" portion of the cycle of operations to insert an additional item to be washed permits the washing chamber 12 to fill with relatively cool ambient-temperature air which rapidly expands. Closing the access door 22 confines the air and causes it to try to escape through all openings. The flapper valve 100 in the present construction provides a means of escape for this expanding air. The rapid air pressure build-up will open the flapper valve 100 to relieve the pressure and the flapper valve 100 will gravitationally close after the pressure has been relieved.

When the timer or sequential control means has advanced to the "dry" portion of a cycle of operations, the blower motor 65 will be energized. The blower motor 65 will turn the blower wheel 71 which will force ambient temperature air through the conduit 33 to open the disk-shaped air valve or baffle 63 to the full line posture of FIG. 6. The ambient temperature air will be directed by the diffuser cap 55 in a downward and outward direction as shown in FIGS. 2, 5 and 6 toward the calrod heater 62 on the bottom wall 16 of the washing chamber 12. When the ambient temperature air is forced over the calrod heater 62, it picks up heat and rises upwardly through the dishes loaded in the baskets. After flowing through and around the dishes and evaporating moisture therefrom, the now hot-moist air is exhausted through the vent-air outlet system 81. The blower 31 forces the hot-moist air through the slots 86 in the vent cover 83 and through the vent duct opening 91. The air follows the serpentine path of FIG. 3 and forces the flapper valve 100 to the full line open posture of FIG. 3. The air exits the vent system 81 through the vent duct exhaust opening 96 where it crosses the air gap 104 and is mixed with ambient temperature air rising between the access door 22 and the door panel 109 and finally passes through the control panel openings 26 to atmosphere. Upon termination of the blower motor 65 operation, the air valve 63 in the inlet conduit 33 and the flapper valve 100 in the vent-air outlet 81 will gravitationally move to the closed posture. It is also anticipated that the described airflow system could be used without energization of the calrod heater 62 to provide an energy saving dry.

The present construction thus provides an improved airflow drying system for a dishwashing apparatus including valve means in both the air inlet and the air outlet sections which open in response to forced airflow and which automatically close upon termination of airflow. The construction precludes the escape of either suds or hot-moist air from the washing chamber prior to the "dry" portion of the cycle of operations.

In the drawings and specification, there has been set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as is further defined in the following claims.

I claim:

1. An airflow system for a dishwasher having a washing chamber, means for washing articles within said chamber, an access door operable between open and closed positions relative to said chamber, and sequence control means for controlling said dishwasher through a sequence of operations including an article washing operation and an article drying operation, the combination comprising: air inlet means for defining an airflow path into said chamber; air circulation means communicating with said chamber through said air inlet means for introducing an airflow into said chamber during said article drying operation; air outlet means for exhausting to the atmosphere the airflow from said chamber after passing over said articles; and inlet valve means and outlet valve means each including a freely supported valve member biased to a closed posture against a stop and movable against said biasing to a stop at an open posture responsive to said airflow and automatically operable to said closed posture upon interruption of said airflow, said outlet valve member also being responsive to increased pressure in said chamber for momentarily opening while said inlet valve member remains closed to relieve internal pressure build-up in said chamber through said air outlet means.

2. An airflow system as defined in claim 1 and further including means for mixing ambient air with the airflow from said chamber before exhausting to the atmosphere.

3. An airflow system for a dishwasher having a washing chamber, means for washing articles within said chamber, an access door operable between open and closed positions relative to said chamber, and sequence control means for controlling said dishwasher through a sequence of operations including an article washing operation and an article drying operation, the combination comprising: air inlet means for defining an airflow path into said chamber; air circulation means communicating with said chamber through said air inlet means for introducing an airflow into said chamber during said article drying operation; air outlet means in said access door defining an airflow path from said chamber; and normally closed inlet and outlet valve means associated with said air inlet and air outlet means and each including a freely supported valve member biased to said closed posture against a stop and movable against said biasing to a stop at an open posture responsive to said airflow during said article drying operation and automatically operable to said closed posture upon interruption of said airflow, said outlet valve member being responsive to increased pressure in said chamber for momentarily opening while said inlet valve member remains closed to relieve internal pressure build-up in said chamber through said air outlet means.

4. An airflow system as defined in claim 3 wherein said inlet valve and said outlet valve are each biased closed by gravity and are operable to said open posture by increased air pressure.

5. An airflow system as defined in claim 3 wherein said outlet means further defines an intermediate air intake for mixing relatively cool dry ambient air with the airflow from said chamber.

6. An airflow system as defined in claim 3 wherein said system further includes heating means within said chamber for heating said airflow introduced into said chamber.

7. An airflow system for a dishwasher having a washing chamber, means for washing articles within said chamber, an access door operable between open and closed positions relative to said chamber and including an inner panel and an outer panel, and sequence control means for controlling said dishwasher through a sequence of operations including an article washing operation and an article drying operation, the combination comprising: air inlet means for defining an airflow path into said chamber; air circulation means communicating with said chamber through said air inlet means for introducing an airflow into said chamber during said article drying operation; air outlet means defining a first opening in said inner panel and a second opening in said outer panel, said air outlet means further defining an airflow path between said first and second openings; and normally closed inlet and outlet valve means associated with said air inlet means and said air outlet means and each including a freely supported valve member biased to said closed posture against a stop and movable against said biasing to a stop at an open posture responsive to said airflow during said article drying operation and automatically operable to said closed posture upon interruption of said airflow, said outlet valve member also being responsive to increased pressure in said chamber for momentarily opening while said inlet valve member remains closed to relieve internal pressure build-up in said chamber through said air outlet means.

8. An airflow system for a dishwasher having a washing chamber, means for washing articles within said chamber, an access door operable between open and closed positions relative to said chamber, and a control panel cooperable with said access door for defining a compartment adjacent the top of said access door to enclose sequence control means operable for controlling said dishwasher through a sequence of operations including an article washing operation and an article drying operation, the combination comprising: means defining an air inlet to said chamber; motor driven air circulation means communicating with said air inlet means for introducing an airflow into said chamber during said article drying operation; air outlet means in said access door adjacent said compartment and defining a first opening for exhausting said airflow from said chamber after passing over said articles, said outlet means defining a second opening in said control panel for conducting said airflow to atmosphere, said outlet means also defining a hood projecting over the upper portion of said control panel opening to prevent air from flowing from said chamber into said compartment and also defining a downwardly opening air gap between said first and second openings; an outer door panel juxtaposed to said access door defining an air passageway therebetween for convectionally conducting ambient-temperature air upwardly toward said air gap for mixing with said airflow from said chamber during said article drying operation; and normally closed inlet and outlet valve means associated with said air inlet and air outlet means and each including a freely supported valve biased to said closed posture against a stop and movable against said biasing to a stop at an open posture responsive to said airflow during said article drying operation and automatically operable to said closed posture upon interruption of said airflow, said outlet valve member also being responsive to increased pressure in said chamber for momentarily opening while said inlet valve member remains closed to relieve internal pressure build-up in said chamber through said air outlet means.

* * * * *